US005784672A

United States Patent [19]

Haneda et al.

[11] Patent Number: 5,784,672

[45] Date of Patent: Jul. 21, 1998

[54] COLOR IMAGE FORMING APPARATUS HAVING INTEGRALLY FORMED/ REMOVABLE IMAGE FORMING BODY AND EXPOSIVE DEVICE

[75] Inventors: Satoshi Haneda; Hisayoshi Nagase; Hiroyuki Tokimatsu; Masahiro Onodera; Shuta Hamada; Toshihide Miura, all of Hachioji, Japan

[73] Assignee: Konica Corporation, Tokyo, Japan

[21] Appl. No.: 821,865

[22] Filed: Mar. 21, 1997

[30] Foreign Application Priority Data

Mar. 29, 1996 [JP] Japan ..... 8-076560

[51] Int. Cl.[6] ..... G03G 15/00

[52] U.S. Cl. ..... 399/118; 347/257

[58] Field of Search ..... 399/116, 118, 399/113, 117, 121, 159, 302, 308, 162; 347/242, 257

[56] References Cited

U.S. PATENT DOCUMENTS

| | | | |
|---|---|---|---|
| 5,122,836 | 6/1992 | Fujiwara et al. | 399/116 |
| 5,220,381 | 6/1993 | Suzuki | 399/113 |
| 5,537,199 | 7/1996 | Takai et al. | 399/226 |
| 5,585,893 | 12/1996 | Fujita et al. . | |
| 5,660,960 | 8/1997 | Kinoshita et al. | 430/54 |
| 5,663,787 | 9/1997 | Haneda et al. | 399/111 |

FOREIGN PATENT DOCUMENTS

| | | |
|---|---|---|
| 02-093481 | 4/1990 | Japan . |
| 03-259271 | 11/1991 | Japan . |
| 05-307307 | 11/1993 | Japan . |
| 06-118746 | 4/1994 | Japan . |

*Primary Examiner*—Robert Beatty

*Attorney, Agent, or Firm*—Frishauf, Holtz, Goodman, Langer & Chick

[57] ABSTRACT

A color image forming apparatus including: an image forming body rotating about a rotary axis; a plurality of imagewise exposure devices mounted on an optical system supporting body and provided inside the image forming body for imagewise exposing the image forming body, wherein the image forming body is integrally formed with the optical system supporting body; a plurality of developing units provided around the image forming body; a suspending member for suspending the optical system supporting body; and guiding member for guiding the suspending member so that the image forming body is pulled out in a direction of the rotary axis of the image forming body.

10 Claims, 7 Drawing Sheets

COLOR IMAGE FORMING APPARATUS HAVING INTEGRALLY FORMED/ REMOVABLE IMAGE FORMING BODY AND EXPOSIVE DEVICE

BACKGROUND OF THE INVENTION

The present invention relates to an electrophotographic type color image forming apparatus in which a plurality of charging means, image exposure means and developing means are arranged around a drum-like image forming body, and in which images are formed by superimposing toner images on the image forming body during a single rotation of the image forming body.

As a multi-color image forming method, a color image forming apparatus is widely known in which image exposure and development of the image are successively repeated corresponding to each color during a single rotation of the image forming body, and a color image is formed by superimposing each color toner image on the image forming body.

However, in such an apparatus, a plurality of charging means, image exposure means and developing means are arranged around an image forming body, and further, a space is necessary for a conveyance area of a transfer material and a cleaning means. Accordingly, the space around the peripheral surface of the image forming body is insufficient, the layout is difficult, a large sized image forming body having a long peripheral length is required, and the arrangement of components tends to be poorly balanced, all of which are disadvantageous.

As a method to solve the insufficient space limitation, the following apparatuses are proposed: an apparatus in which the base body of the image forming body is made of a transparent material, each image exposure means is accommodated in the image forming body, and image exposure is carried out from the inside of the image forming body; and further, an apparatus in which the conveyance surface of a transfer material conveyed from the tangential direction with respect to a transfer area is set at a position separated from the peripheral surface of the image forming body by utilizing an intermediate transfer body.

In these apparatuses, the image exposure means is generally incorporated into the apparatus as a unit integrated with the image forming body in order to assure accurate exposure onto the photoreceptor surface and to more easily handle the image exposure means. Accordingly, when the image exposure means together with the image forming body is attached to and detached from the apparatus during maintenance or replacement work, it is required that the unit-like image exposure means and image forming body, in which the weight becomes large, can be operated to move without interfering with the plurality of charging means and developing means which are arranged around the outer periphery.

Further, in an apparatus in which an intermediate transfer body is used for an image transfer process, it is further required to withdraw the intermediate transfer body in advance from the peripheral surface of the image forming body when the image forming body is attached to and detached from the apparatus.

SUMMARY OF THE INVENTION

An object of the present invention is to provide a color image forming apparatus in which the unit-like image exposure means and image forming body can be safely and easily attached to and detached from the apparatus without interfering with the developing means or the intermediate transfer body, by means of an extremely simple structure and operation method.

The above object can be attained by a color image forming apparatus comprising the following structure:

an image forming body rotating around an axis;

a plurality of image exposure devices arranged inside the image forming body and attached to an optical system supporting body, the image forming body being rotatably provided to the optical system supporting body;

a plurality of developing devices arranged around the image forming body so that these developing devices surround the image forming body;

a suspending member to suspend the optical system supporting body; and a guiding member, wherein the suspending member is structured so that it can be pulled out in the direction of the rotating axis of the image forming body by the guiding member.

DETAILED DESCRIPTION OF THE PREFERRED EMBODIMENT

Figure 1:
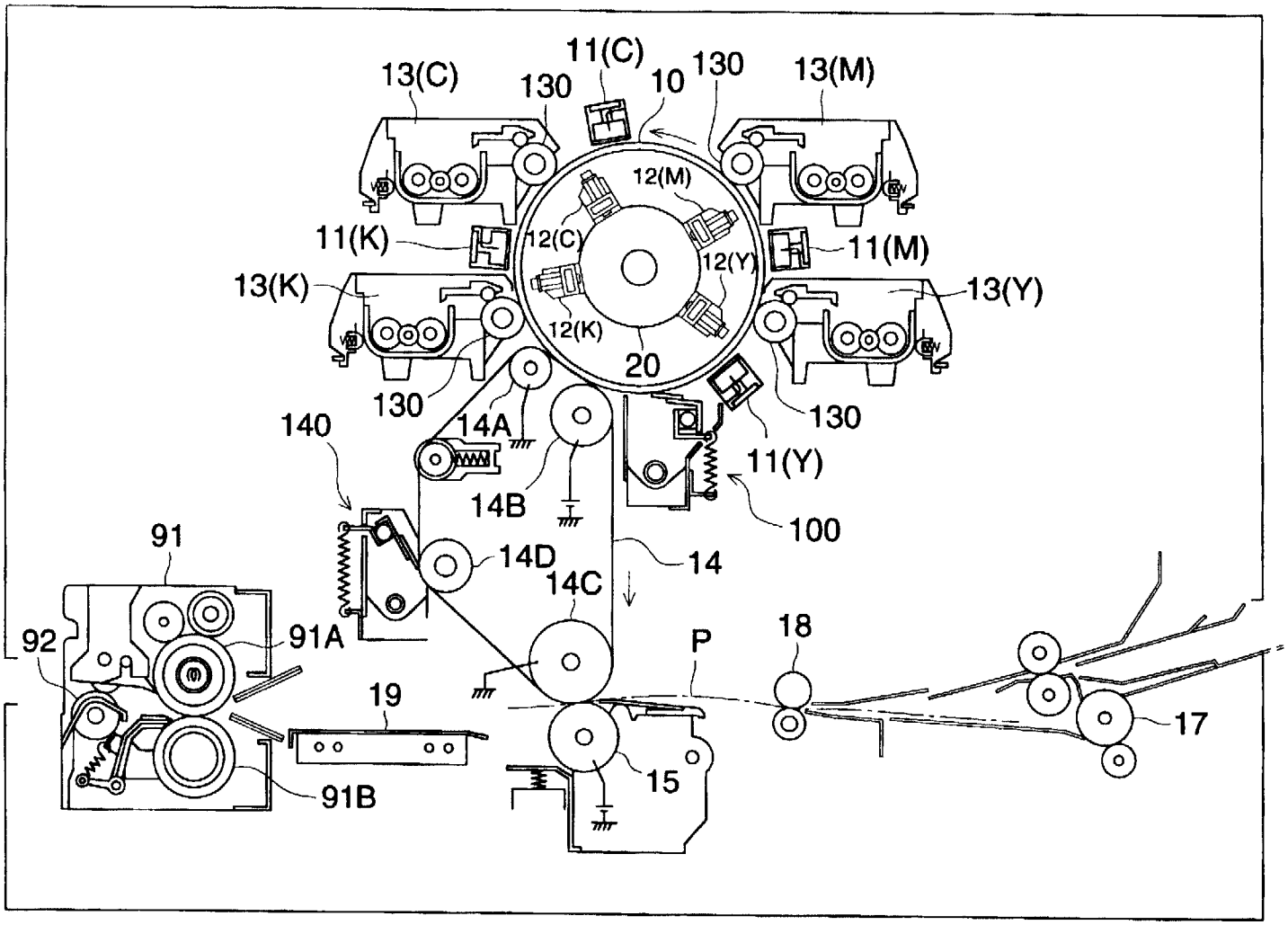
FIG. 1 is a structural sectional view of a color image forming apparatus.

Previous to an explanation of examples of the present invention, a structure of a color image forming apparatus, which is common to each example, will be described below, referring to FIG. 1.

Numeral 10 is a drum-like image forming body, that is, a photoreceptor drum, in which a transparent electroconductive layer and an organic photoreceptor layer (OPC) are coated on the outer peripheral surface of a cylindrical base body which is formed of a transparent member such as optical glass or a transparent acrylic resin, and the photoreceptor drum 10 is rotated counterclockwise.

Numerals 11 (Y, M, C, K) are scorotron chargers (hereinafter, simply called charger), in which a charging operation is carried out by a grid and a discharge wire, the potential voltage between which is kept at a predetermined value with respect to the organic photoreceptor layer of the photoreceptor drum 10, so that a uniform potential voltage is applied on the photoreceptor drum 10.

Numerals 12 (Y, M, C, K) are exposure optical systems, composed of LEDs axially aligned with the photoreceptor drum 10, and a Selfoc lens which is a life-sized imaging system. Each color image signal which has been read out by a separated image reading device, is successively read from a memory and is respectively inputted into each exposure optical system 12 (Y, M, C, K) as an electrical signal.

The exposure optical systems 12 (Y, M, C, K) are mounted on a supporting member 20 provided as an optical system supporting means, and accommodated inside the base body of the photoreceptor drum 10.

Numerals 13Y through 13K are developing devices in which yellow (Y), magenta (M), cyan (C) and black (K) developers are accommodated, and each developing device has a developing sleeve 130 which is rotated in the same direction as the photoreceptor drum 10 with a predetermined gap with respect to the peripheral surface of the photoreceptor drum 10.

The developing device non-contact reversal-develops an electrostatic latent image on the photoreceptor drum 10 which was formed by charging by chargers 11(Y, M, C, K), and image exposure by each exposure optical systems 12(Y, M, C, K), by applying a developing bias voltage onto the photoreceptor drum 10.

Next, a process of color image formation in the present apparatus will be described.

Related to a document image, an image having been read by an image pick-up element or an image having been edited by a computer in an image reading apparatus, which is provided separately from the present apparatus, is temporarily stored in a memory as an image signal for each of colors Y, M, C and K.

When a photoreceptor driving motor starts at a start of the image recording process, the photoreceptor drum 10 is rotated counterclockwise, and simultaneously, application of a potential voltage onto the photoreceptor drum 10 is initiated by a charging operation of the charger 11 (Y).

After the potential voltage has been applied to the photoreceptor drum 10, exposure by an electric signal corresponding to a first color signal, that is, a yellow (Y) image signal, starts, and an electrostatic latent image corresponding to the yellow (Y) image of the document image is formed on the photoreceptor layer on the surface of the photoreceptor drum by rotational scanning of the drum.

The latent image is reversal-developed under a non-contact condition by a developer on a developing sleeve of the developing device 13 (Y), and a yellow (Y) toner image is formed corresponding to the rotation of the photoreceptor drum 10.

Next, on the photoreceptor drum 10, a potential voltage is further applied on the yellow (Y) toner image by a charging operation of the charger 11(M); exposure is carried out by an electric signal corresponding to the second color signal, that is, a magenta (M) image signal, by the exposure optical system 12(M); and a toner image is formed by successively superimposing a magenta (M) toner image on the yellow (Y) toner image by non-contact reversal development by the developing device 13(M).

By the same process, a cyan (C) toner image corresponding to the third color signal is formed by the charger 11(C), exposure optical system 12(C) and developing device 13(C), and is superimposed on the previous toner images. Further, a black (K) toner image corresponding to the fourth color signal is formed by the charger 11(K), exposure optical system 12(K) and developing device 13(K), and is superimposed on the three previous toner images. Thus, a color toner image is formed on the peripheral surface of the photoreceptor drum 10 during a single rotation of the photoreceptor drum 10.

Exposure onto the organic photoreceptor layer of the photoreceptor drum 10 by these exposure optical systems is carried out through the transparent base body from the inside of the drum at the above-described exposure wavelengths. Accordingly, the image exposure corresponding to the second, third and fourth color signals is carried out without being influenced at all by the previously formed toner images, and the electrostatic latent image, equivalent to the image corresponding to the first color signal, can be formed. In this connection, the stabilization of temperature and prevention of the temperature rise in the photoreceptor drum 10 due to heat generation of exposure optical systems 12(Y, M, C, K) can be achieved to an acceptable degree by taking countermeasures such as use of an excellent heat conductive material for the supporting member 20, use of a heater during low temperature operations, and radiation of heat from the system to the outside through a heat pipe during high temperature operations. Further, when the developing operation is carried out by each developing device, a DC developing bias voltage or an AC developing bias voltage, in addition to the DC bias voltage, is applied onto respective developing sleeve 130; jumping development is carried out by a one-component or two-component developer which is accommodated in the developing device; and non-contact reversal development is carried out onto the photoreceptor drum 10, in which the transparent conductive layer is grounded.

The color toner image thus formed on the peripheral surface of the photoreceptor drum 10 is temporarily transferred onto the peripheral surface of an intermediate transfer belt 14, which is provided as an intermediate transfer means.

The intermediate transfer belt 14 is formed of 100–500 μm thickness urethane rubber, having an electric resistance of $10^8$–$10^{12}$ Ω·cm, and further, a 5–50 μm thickness Teflon layer having the same electric resistance value is provided for toner filming prevention, as a surface layer. The intermediate transfer belt 14 is stretched around rollers 14A, 14B, 14C and 14D, and is circularly conveyed clockwise by the moving power transmitted to the roller 14D, in timed relationship with the peripheral speed of the photoreceptor drum 10.

In the intermediate transfer belt 14, the belt surface between the roller 14A and the roller 14B contacts with the peripheral surface of the photoreceptor drum 10, while the belt surface of the outer periphery of the roller 14C contacts with a transfer roller 15, which is a transfer member, and at the respective contact points, transfer areas of the toner image are formed.

A color toner image adhered onto the peripheral surface of the photoreceptor drum 10 is initially transferred successively onto the peripheral surface side of the intermediate transfer belt 14 when a bias voltage, having opposite polarity to the toner, is applied onto the roller 14B, at the contact point of the photoreceptor drum 10 with the intermediate transfer belt. That is, the color image on the drum is conveyed to the transfer area, being guided by grounded roller 14A, without scattering of the toner, and when 1–2 kV bias voltage is applied on the roller 14B, the color toner image is efficiently transferred onto the intermediate transfer belt 14 side.

On the other hand, by an operation of a sheet feed roller 17 of a sheet feed cassette (not shown in the drawings), a recording sheet P is conveyed and sent to a timing roller 18, and then sent to the transfer area of the transfer roller 15, in synchronization with the conveyance of the color toner image on the intermediate transfer belt 14.

The transfer roller 15 is rotated counterclockwise, being synchronized with the peripheral speed of the intermediate transfer belt 14. The fed recording sheet P is closely contacted with the color toner image on the intermediate transfer belt 14 in the transfer area formed by a nip portion between the transfer roller 15 and the grounded roller 14C, and the color toner image is successively transferred onto the recording sheet P by applying the 1–2 kV bias voltage, having opposite polarity to the toner, onto the transfer roller 15.

The recording sheet P onto which the color toner image has been transferred, is then discharged, and is conveyed to a fixing device 91 through a conveyance plate 19; it is conveyed being nipped between a heat roller 91A and a pressure roller 91B, heated to fuse a toner, and fixed; and after that, it is delivered outside the apparatus through a delivery roller 92.

Cleaning devices 100 and 140 are respectively provided on the photoreceptor drum 10 and the intermediate transfer belt 14, and blades provided therein are always in pressure-contact with the photoreceptor drum 10 and the intermediate transfer belt 14, so that residual adhered toner is removed and their respective peripheral surfaces are always kept clean.

(EXAMPLE 1)

An example of the present invention will be described below referring to FIG. 2 though FIG. 4.

Figure 2:
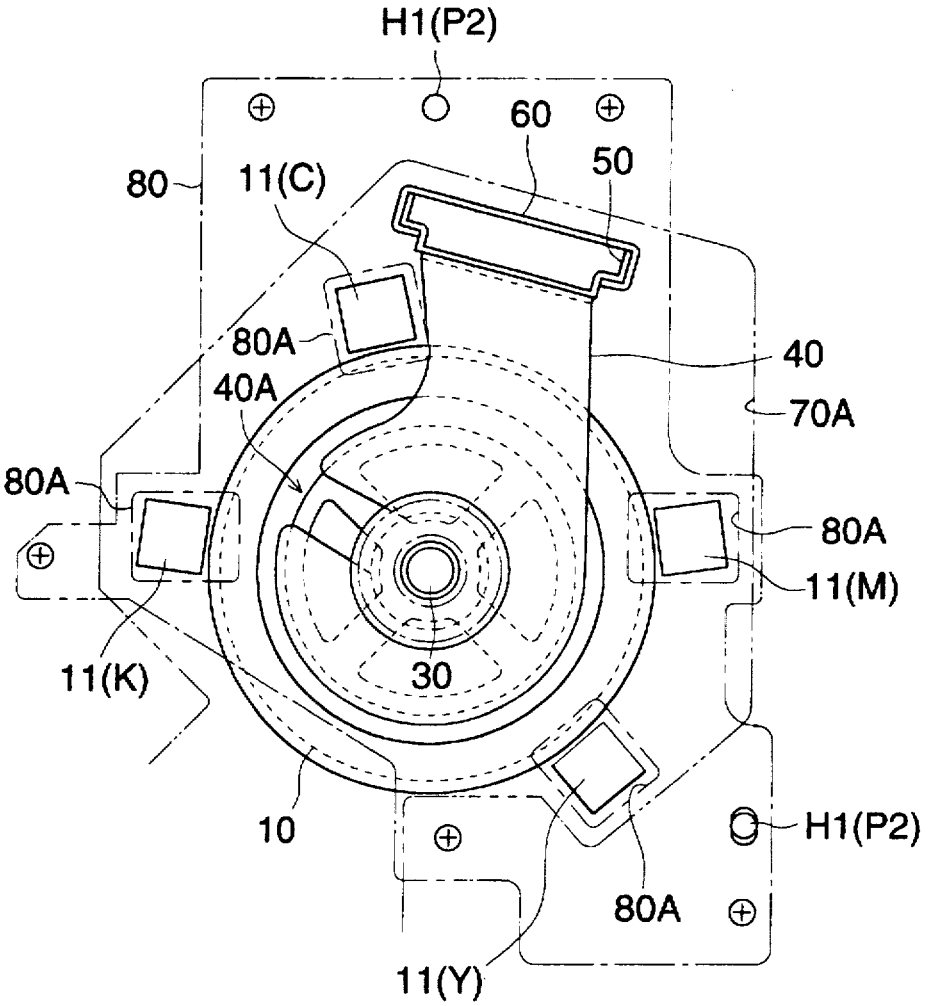
FIG. 2 is a front view showing a supporting structure of a photoreceptor drum.
Figure 3:
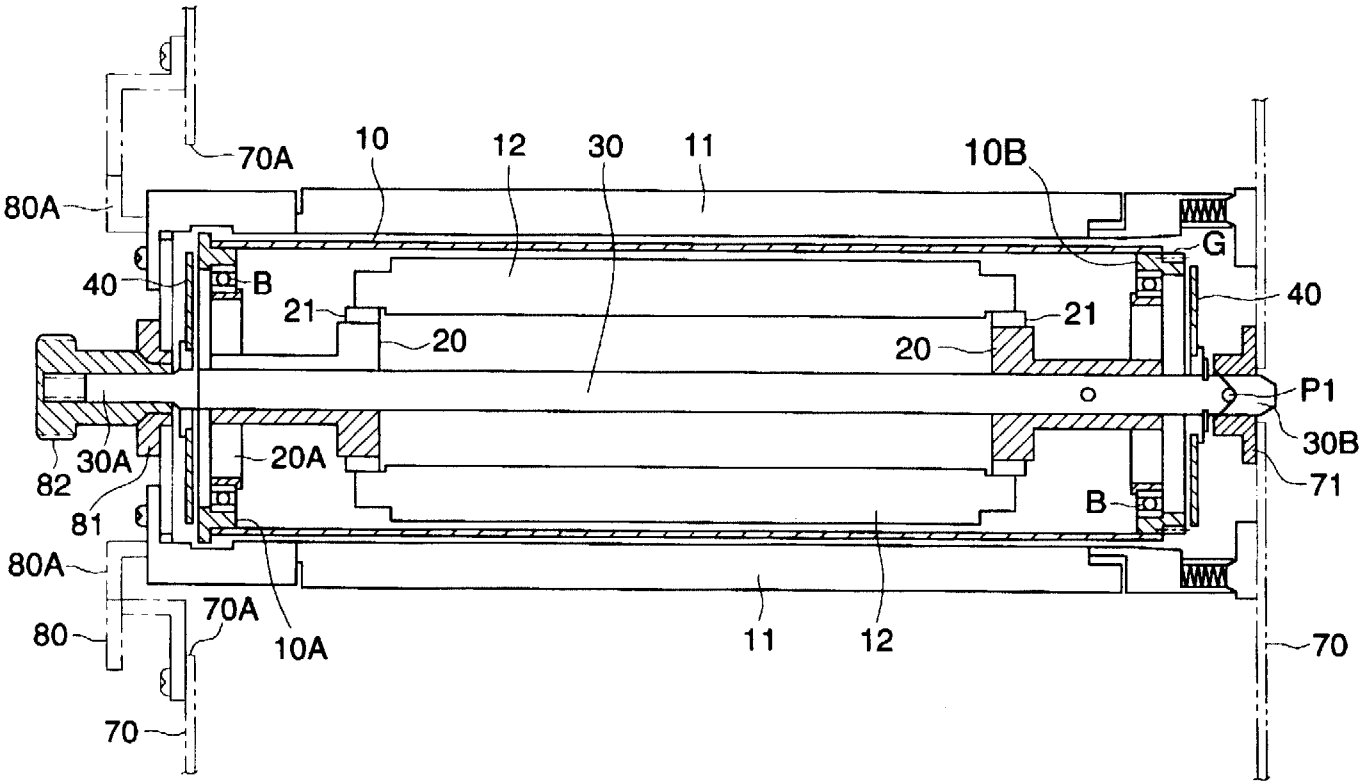
FIG. 3 is a sectional view showing the supporting structure of the photoreceptor drum.

As shown in FIGS. 2 and 3, the supporting member 20 is composed of a couple of members which are fixed at the front and rear portions on the rotation supporting shaft 30 of the photoreceptor drum 10. Exposure optical systems 12(Y, M, C, K) are adjusted such that both end portions of each exposure optical system have a predetermined positional relationship with respect to the photoreceptor surface through adhering members 21, and are fixed at adjustment positions by adhesion. That is, each of exposure optical systems 12(Y, M, C, K) is supported by the supporting members 20 and the rotation supporting shaft 30.

On the other hand, the photoreceptor drum 10 is rotated such that the flange members 10A and 10B, which are provided at both end portions of the photoreceptor drum 10, are rotatably supported respectively by the supporting members 20 through bearings B, and is rotated around the rotation supporting shaft 30, which is now stationary, by the drive of a gear G which is provided on the flange member 10B.

The rotation supporting shaft 30 is supported by the bearings between symmetrical front and rear side-plates 40, which are formed into a C-shape and integrally connected with each other. By this method, the supporting members 20 as the optical system supporting body, and the rotation supporting shaft 30 are suspended by the side plates 40 which are suspension means.

Rail members 50 are provided at the front and rear connecting portions of the side plates 40, and when the rail members 50 are inserted into and engaged with guide members 60 provided in the apparatus main body, each exposure optical system 12 (Y, M, C, K) and the photoreceptor drum 10 are placed at predetermined positions.

Further, changing from the condition of suspension by the side plate 40, when the rotation supporting shaft 30 is inserted into its regular position, a shaft end portion 30B projected from the rear side-plate 40 is engaged with a bushing 71 which is provided on the base plate of the apparatus, and a shaft end portion 30A projected from a front side-plate 40 is supported by a screw member 82 which is engaged with a tapered bushing 81 provided on a supporting base plate 80. Thereby, the photoreceptor drum 10 is accurately regulated at a regular setting position and the gear G is engaged with a drive-side gear. On the other hand, each exposure optical system 12 is exactly regulated at a predetermined angular position with respect to the apparatus main body and becomes stationary when a penetration pin P1 provided on the shaft end portion 30B is engaged with a V-shaped groove which is formed in the bushing 71. Then, lead wires of each optical system are connected with a power supply portion through each front window 20A of the supporting member 20 and a cutout portion 40A of the side plate 40.

Upper and lower reference holes H1 of the supporting base plate 80 are engaged with a couple of reference pins P2 provided on the front base plate 70 of the apparatus so that the attachment position is determined, and the supporting base plate 80 is screwed to the front plate 70 of the apparatus at a plurality of places. Further, a plurality of windows 80A are opened, and the bar-like chargers 11 (Y, M, C, K) are inserted from the outside of the supporting base plate 80 so that the chargers are set at predetermined positions with respect to the photoreceptor drum 10, then fixed by screws while being connected to electrodes, and supported.

Accordingly, when the screw member 82 is removed under the condition that chargers 11(Y, M, C, K) are removed through the window 80A, the supporting base plate 80 is separated from the apparatus base plate 70 only by releasing a plurality of screws. From this condition, the side plate 40 slides on the rail member 50 being guided by the guide member 60, moves horizontally under the condition that the photoreceptor drum 10 and exposure optical systems 12(Y, M, C, K) are integrated with each other, and can be taken from an opening 70A of the apparatus base plate 70 to the outside of the apparatus main body.

Figure 7:
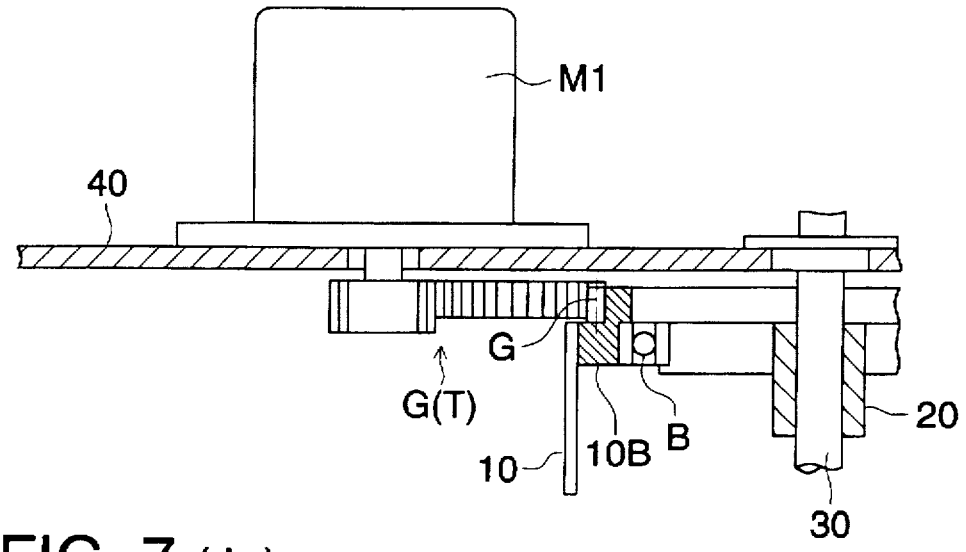
FIG. 7(*a*) is a sectional view showing a driving system of a photoreceptor drum, and FIG. 7(*b*) is a sectional view showing a driving system of the intermediate transfer belt.
Figure 7:
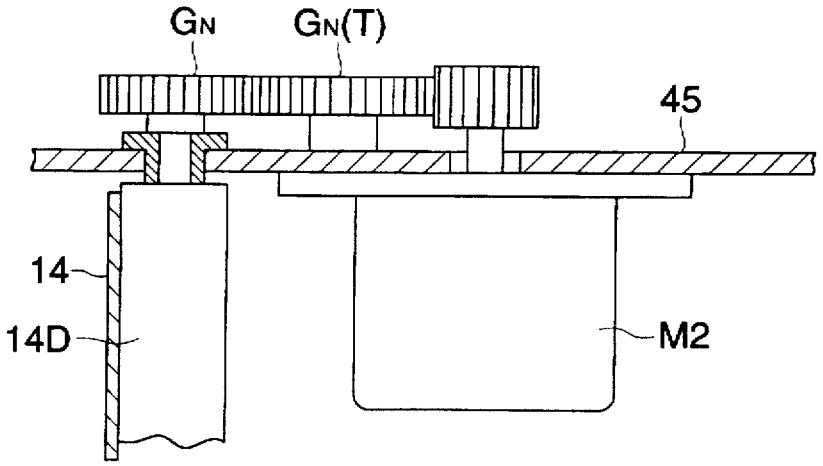

A drive motor M1 to drive the gear G and its power transmission means, that is, a driving system G (T) of the gear G are attached onto the rear side-plate 40, and supported (refer to FIG. 7(*a*)). Further, this system can be structured as follows: the driving system of the developing devices 13(Y, M, C, K) is also supported, and the power transmission means for developing devices 13(Y, M, C, K) is automatically engaged with or disengaged from the developing devices according to attachment or detachment of the side-plate 40.

Before the start of attachment to or detachment from the apparatus main body of the photoreceptor drum 10, supported by the side-plate 40, it is assumed that pressure-contact operations of developing devices 13(Y, M, C, K), the intermediate transfer belt 14, and the blades of the cleaning device 100 onto the peripheral surface of the photoreceptor drum 10, have previously been released and these devices have been withdrawn by about 1–10 mm from the drum surface, and are restored to the pressure-contact condition after attachment of the photoreceptor drum 10 to the apparatus main body.

Figure 4:
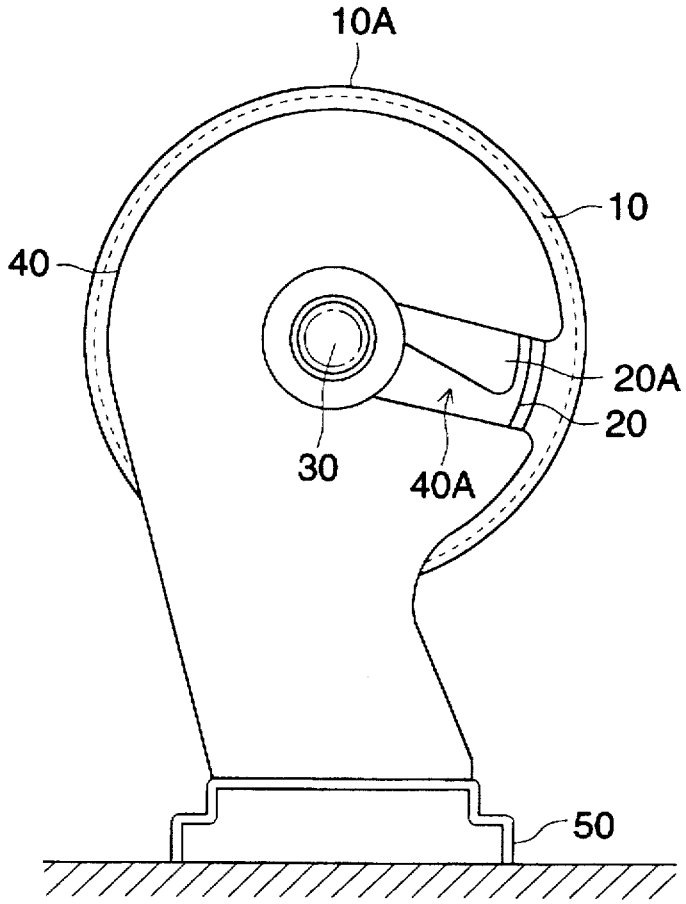
FIG. 4 is a view of the appearance of a drum unit.

In this connection, the side-plate 40 functions as a stand on which the photoreceptor drum and other devices are placed with good balance so as to not be in contact with the floor, while the rail member 50 is placed on the lower side as shown in FIG. 4 after the photoreceptor drum and other devices are detached from the apparatus main body, and is also utilized for protection of the photoreceptor surface.

(EXAMPLE 2)

Figure 5:
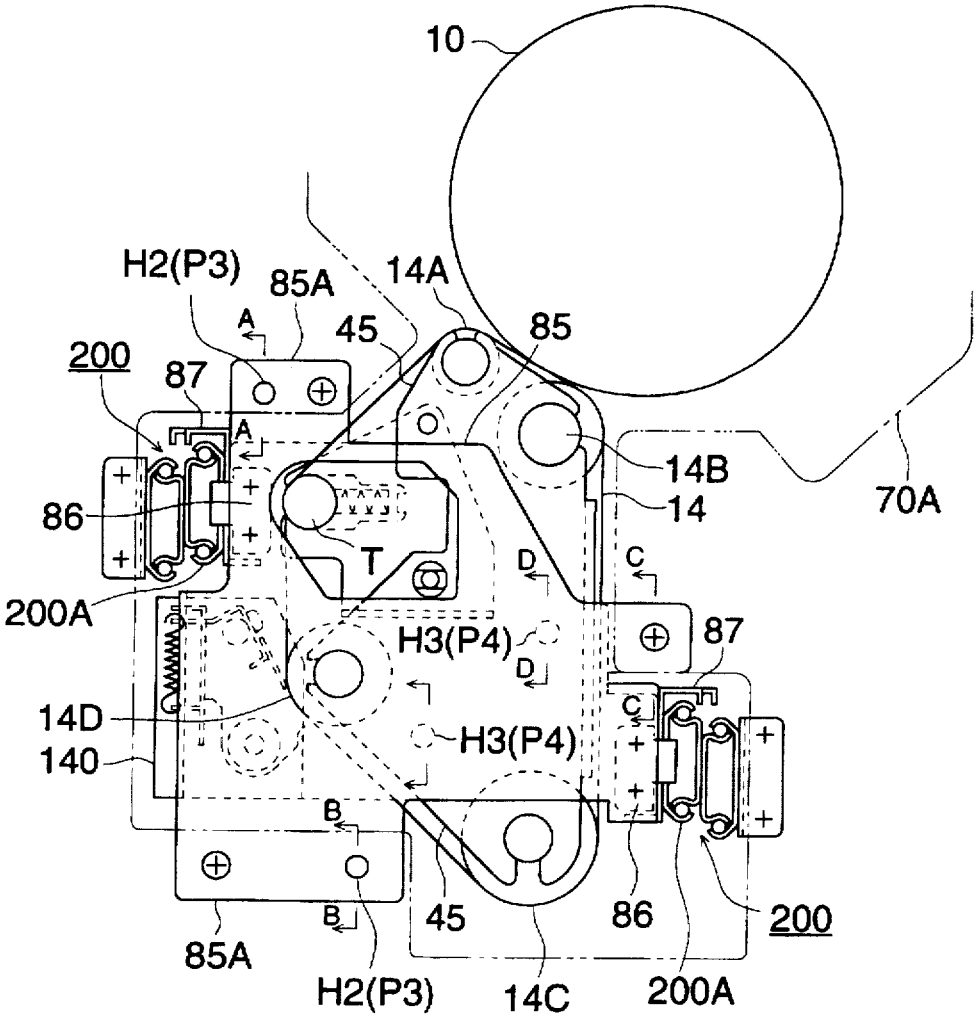
FIG. 5 is a front view showing a supporting structure of an intermediate transfer belt.
Figure 6:
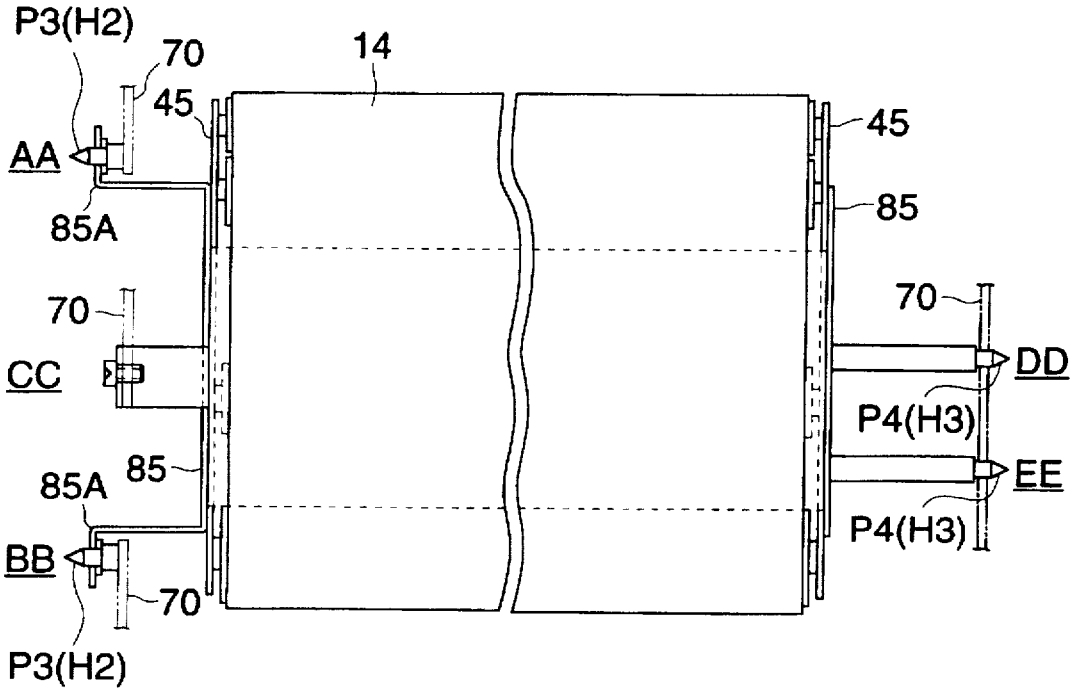
FIG. 6 is a sectional view showing the supporting structure of an intermediate transfer belt.

Another example of the present invention will be explained by FIGS. 5 and 6, showing sections AA through EE of FIG. 5.

Rollers 14A and 14D, around which the intermediate transfer belt 14 is stretched under the tension by a tension roller T, are supported by bearings, between front and rear side-plates 45 which are formed into a C-shape and integrally connected with each other.

The side-plates 45 are sandwiched between asymmetrical front and rear supporting base plates 85, which are also formed into C-shape and integrally connected with each other, together with the cleaning device 140, and all of them are integrated with each other.

The front supporting base plate 85 is provided with reference holes H2 as a suspension means on upper and lower rising portions 85A. On the other hand, the rear supporting base plate 85 is provided with a couple of reference pins P4, which also serve as a suspension means, on its back. When the reference hole H2 is engaged with the reference pin P3 provided on the front base plate 70 of the apparatus and fixed by screws, and when the reference pin P4 is engaged with the reference hole H3 provided on the rear base plate of the apparatus and fixed by screws, the intermediate transfer belt 14 is set at a predetermined position; it is in pressure-contact with the peripheral surface of the photoreceptor drum 10 and composes the first transfer area in which the toner image is transferred from the photoreceptor drum 10 onto the intermediate transfer belt 14; and the second transfer area is composed in which the toner image is transferred from the intermediate transfer belt 14 onto the transfer material by the pressure-contact of the transfer roller 15.

The supporting base plate 85 is supported so as to be drawn toward the front surface of the apparatus main body on a couple of guide rails 200, which are called Arcuride rails (trade name) and expandable by two steps, with respect to the front and rear base plates 70 of the apparatus.

The supporting base plate 85 is structured as follows: a couple of front and rear guide plates 86, respectively provided on the left and right side-portions, nip a removable portion 200A of the guide rail 200 so as to be vertically slidable; the guide plates 86 is integrated with the movable portion 200A in the draw-out direction of the supporting base plate 85; and the base plate 85 can be vertically lowered until a collision plate 87 collides with the movable portion 200A.

After the screws have been loosened, the above-described reference pins are disengaged from the reference holes by a slight draw-out operation of the supporting base plate 85 toward the front of the apparatus main body, and the supporting base plate 85 is slightly lowered. Accordingly, the supporting base plate 85 is largely drawn out through the opening 70A of the apparatus base plate 70 toward the front of the apparatus main body by the expanding operation of the guide rail 200, under the condition that the each collision plate 87 is located on the movable portion 200A. As a result, the intermediate transfer belt 14 is withdrawn from the peripheral surface of the photoreceptor drum 10, and is drawn out under the condition that the pressure-contact is released. When the intermediate transfer belt 14 is re-attached, it is moved slightly upward by the restoration of the guide rail 200 from the extension condition and by the guide of tapered portion of each reference pin, so that the restoring operation to the pressure-contact condition with the photoreceptor drum 10 is automatically and assuredly carried out.

Accordingly, by the very easy attachment and detachment operation of the supporting base plate 85, the photoreceptor drum 10 can be removed without interfering with the intermediate transfer belt 14, and further by the draw-out operation of the supporting base plate 85, the maintenance operations such as taking out processing of jammed sheets in the conveyance path, replacement of the intermediate transfer belt 14, inspection, etc., can be easily carried out.

A driving system composed of a drive motor M2, which drives a gear $G_N$ provided on the end portion of the roller 14D to drive the intermediate transfer belt 14, being engaged with the gear, and its power transmission means $G_N(T)$ can be attached onto the rear surface of the side plate 45 (refer to FIG. 7(*b*)). Further, it can be structured in such a manner that the driving system of the photoreceptor drum 10 is attached onto the side plate 45 so that the power transmission means for the photoreceptor drum 10 can be automatically engaged with and disengaged from the apparatus corresponding to the sliding operation of the supporting base plate 85. Still further, the following is possible: the above driving systems are integrated into a single unit, and the unit is supported by the side plate 45.

In this connection, before the draw-out operation of the supporting base plate 85 from the apparatus main body, the pressure-contact operation of the transfer roller with the roller 14C, around which the intermediate transfer belt 14 is stretched, is previously released, and after the supporting base plate 85 has been restored to a predetermined setting position, the transfer roller is again in pressure-contact with the roller 14C.

Due to the present invention, even if the photoreceptor drum is a relatively heavy unit which includes a plurality of exposure optical systems and is integrated with a driving system, it can be safely and assuredly attached to and detached from a predetermined setting position at which it interferes with chargers and developing devices. Further, by suspending the optical supporting body, there is no difficulty in the rotation of the photoreceptor drum while the optical system is kept in a stationary state. On the other hand, an intermediate transfer belt is structured such that it can be in pressure-contact with the photoreceptor drum and can release the pressure-contact with the photoreceptor drum by a simple operation, and further it can be pulled out. Thereby, a color image forming apparatus can be provided in which jam processing and the maintenance operation are easy and which is excellent in practicability.

What is claimed is:

1. A color image forming apparatus comprising:

(a) an image forming body rotating around a rotary axis;

(b) a plurality of imagewise exposure devices attached to an optical system supporting body and arranged inside the image forming body for imagewise exposing the image forming body, wherein the image forming body is rotatably provided on the optical system supporting body and wherein the image forming body and the plurality of imagewise exposure devices are integrally formed into a unit through the optical system supporting body;

(c) a plurality of developing units arranged so as to surround the image forming body;

(d) a suspending member for suspending the optical system supporting body; and (e) a guiding member for guiding the suspending member so that the suspending member is pulled out in a direction of the rotary axis of the image forming body.

2. The color image forming apparatus of claim 1, wherein the suspending member includes a rail member which is engaged with the guiding member.

3. The color image forming apparatus of claim 1, further comprising a gear provided at an end of the image forming body, a drive motor for driving the gear, and a transmitter for transmitting power from the motor to the gear.

4. The color image forming apparatus of claim 1, further comprising a drive motor for driving the plurality of developing units and a power transmitter for transmitting power from the drive motor to the developing units.

5. The color image forming apparatus of claim 1, wherein the suspending member forms a stand on which the image forming body may be placed.

6. The color image forming apparatus of claim 1, wherein the plurality of imagewise exposure devices are wired on a side opposite to a drive side of the image forming body and the plurality of developing units.

7. The color image forming apparatus of claim 1 further comprising:

an intermediate transfer member for transferring a toner image formed on the image forming body onto a recording sheet; and a supporting member for supporting and suspending the intermediate transfer member, wherein when the supporting member is moved in the direction of the rotary axis of the image forming body, the intermediate transfer member can be pulled out from the apparatus.

8. The color image forming apparatus of claim 7, further comprising a drive motor for driving the intermediate transfer member and a transmitter for transmitting power from the motor to the intermediate transfer member.

9. The color image forming apparatus of claim 7, further comprising a gear provided at an end of the image forming body, a drive motor for driving the intermediate transfer member, and a transmitter for transmitting power from the motor to the intermediate transfer member.

10. The color image forming apparatus of claim 7, wherein a driving system for the image forming body and a driving system for the intermediate transfer member are integrally formed into a unit and fixed on the supporting member.

* * * * *